US007681296B2

(12) United States Patent
Rapp

(10) Patent No.: US 7,681,296 B2
(45) Date of Patent: Mar. 23, 2010

(54) METHOD AND TOOL FOR PRODUCING A PRESS JOINT CONNECTION

(75) Inventor: Eugen Rapp, Baden-Wuerttem-Berg (DE)

(73) Assignee: Tox Pressotechnik GmbH & Co. KG, Weingarten (DE)

( * ) Notice: Subject to any disclaimer, the term of this patent is extended or adjusted under 35 U.S.C. 154(b) by 0 days.

(21) Appl. No.: 12/214,369

(22) Filed: Jun. 17, 2008

(65) Prior Publication Data

US 2009/0007738 A1 Jan. 8, 2009

Related U.S. Application Data

(63) Continuation of application No. 10/257,041, filed as application No. PCT/DE01/01289 on Apr. 4, 2001, now abandoned.

(30) Foreign Application Priority Data

Apr. 5, 2000 (DE) ..... 100 16 780

(51) Int. Cl.
*B23P 11/00* (2006.01)
*B23P 19/00* (2006.01)

(52) U.S. Cl. ..... 29/505; 29/521; 29/522.1; 29/525.14; 29/243.5; 403/282

(58) Field of Classification Search ..... 29/505, 29/521, 522.1, 525.14, 798, 243.5; 72/466, 72/466.4, 466.5, 466.8; 403/282, 285
See application file for complete search history.

(56) References Cited

U.S. PATENT DOCUMENTS

| | | | | |
|---|---|---|---|---|
| 2,288,308 | A * | 6/1942 | Williams | 29/566 |
| 4,825,525 | A * | 5/1989 | Obrecht et al. | 29/243.5 |
| 5,051,020 | A * | 9/1991 | Schleicher | 403/282 |
| 5,622,442 | A * | 4/1997 | Schleicher | 403/282 |
| 5,737,819 | A * | 4/1998 | Sawdon et al. | 29/243.5 |
| 7,003,861 | B2 * | 2/2006 | Sawdon et al. | 29/432 |

* cited by examiner

*Primary Examiner*—Jermie E Cozart
(74) *Attorney, Agent, or Firm*—Jordan and Hamburg LLP

(57) ABSTRACT

A method and tool for producing a press joint connection, in which portions of the radial lateral walls of an opening of a die are configured as flexible displaceable segments, whereas other sections, when viewed from a periphery of the opening, remain rigidly connected to the die.

18 Claims, 1 Drawing Sheet

METHOD AND TOOL FOR PRODUCING A PRESS JOINT CONNECTION

This application is a continuation of Ser. No. 10/257,041 filed Feb. 21, 2003 now abandoned and is a 371 of PCT/DE01/01289 filed Apr. 4, 2001.

BACKGROUND OF THE INVENTION

The invention is directed to a method of connecting construction parts such as plates, bolts, nut, etc., with a plate, by using a press joint connection of a type.

In one recognized method based on the same general type mentioned above (DE-05 35 32 900), the material that is displaced from the plate into the lower die opening flows outward in a radial motion to the walls of lower die opening because of the base of the lower die, whereby the displaced material grips the rim of the opening produced by the die and therefore creates a solid connection between the construction element and the plate. This method of connection is normally called a press joint connection. It can be used for connecting two or more stacked plates or for connecting bolts etc. to one or more plates whereby the so-called lost die that is used is either made of soft formable material which is hard enough to perform one press through the plate or to make the corresponding radial cavity within which the displaced plate material can be formed.

The disadvantage of this extremely quick and precise press joint connection with a lower die having inflexible restricting walls, is that it leads to connection points having a limited elasticity.

SUMMARY OF THE INVENTION

The method based on the invention provides the advantage that at a high degree of functional security, a higher elasticity connection is made in establishing the connection point between equal segments, so that the final technical shear and head traction values are higher than for the connection points mentioned above. The elasticity that is achieved is advantageous, in that the ability to work using the method and the tool are retained.

Along with the tool, there is also the advantage that the flexible radial segments that flow outward always land back in their original positions after the operating cycle. There are tools that are recognized which have the radial restricting walls of the lower die made of flexible sections (DE-OS 44 35 460 and DE-GM 297 00 868), but these have the disadvantage that all sections are positioned flexibly, so that remnants of the processed material can get caught in between the individual sections in such a way that the sections can no longer return to their original positions, thus decreasing the ability to produce the required connection quality.

Based on an advantageous version of the method based on the invention, the distribution of the radial resistance in reference to the circumference of the lower die opening is centrally symmetrical. This achieves even strength on the connection points.

Another advantageous version of the invention supplements the press joint connection by introduction of adhesive.

In accordance with another advantageous version of the invention as a tool, the segment height matches the depth of the lower die opening without movement of the flexible segments, which ensures that the base of the lower die opening remains at its own level even with the enlarged opening caused by the flexed segmentation.

In another version of the invention, the volume of the material to be displaced in the initial position (before the assembly procedure) is a bit more than the volume of the lower die opening minus the portion of the intrusion (punch) volume of the form die receivable in the opening which leads to a die chamber. The extra volume causes radial movement of the segments.

In another version of the invention, the segments can move against a tension force. The tension can be created in different ways, but the main feature is that the segments return to their original positions after the work procedure, and the return of the die or the removal of the connection point from the lower die opening.

In another version of the invention, the segments are fed into cavities which run into the same level as the base of the opening and have guide bands on the sides which run in the radial movement direction of the segments. Any remaining material is pushed back and discarded with this method, without any danger of the material being pushed into a gap or reducing the functionality.

Based on another version of the invention, the opposing guide walls of the segments run parallel to inflexible wall segments.

Another version of the invention has leaf or bar springs for tension on the die. Besides being easy to implement and secure in their functionality, these types of springs take up a minimum amount of space.

In another version of the invention, the segments are run in grooves of the die, which results in the ability to decrease the radial dimensions.

In a further version of the invention, the springs on the far (base) end of the segments are connected together as one piece over a connecting section, such that there is an offset of the same amount in a junction section between the connecting section and the springs, in the direction of the casing parts which include the flexible segments. This allows the segments to connect together better, and the spring system is extremely economical to manufacture. There is also a very significant reduction in the danger of breakages occurring, or other kinds of breakdown.

In a further relevant advantageous version of the invention, the connecting section is located in a jointing section of the lower die which runs transverse to the direction of the drive, and which allows the connecting section to be permanently integrated into the lower die.

In a further version of the invention, this connecting section is made in a cross or star form depending on how many springs must be connected together.

In a further version of the invention, there are grooves made in a longitudinal direction and/or on the face side in the mold parting section to receive the springs and/or the connecting section. This allows one to obtain an assembly as a lower die which is self-contained, and therefore more easily installed and removed. Another advantage, not even mentioned yet, is reduction of damage due to external interventions.

Further advantages and advantageous versions of the invention can be taken from the following description, drawing and claims.

One embodiment of the invention, in a variety of versions, is shown in the drawings, and will be described in more detail below.

DETAILED DESCRIPTION OF THE INVENTION

Figure 1:
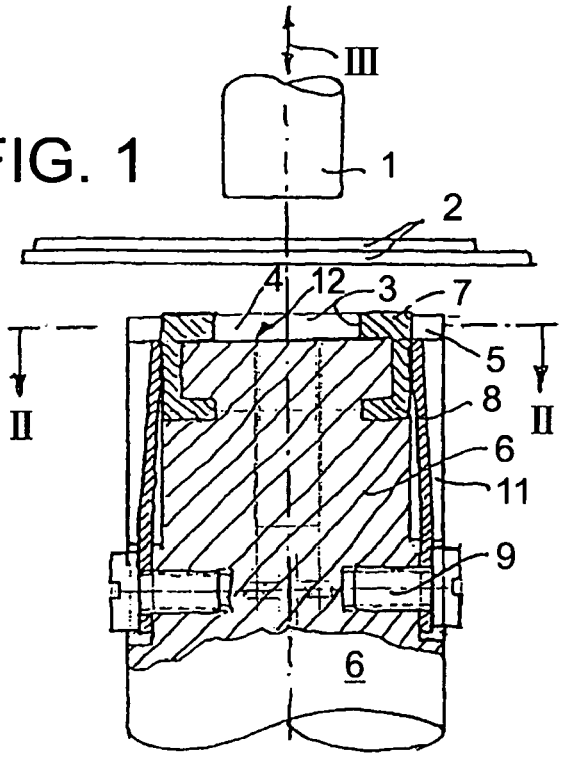
FIG. 1 is an exploded diagram shown in partial cross-section along I-I in FIG. 2.

FIG. 1 shows an exploded diagram of a novel tool that is a punch 1 which can be actuated according to Arrow III over the range of a working stroke thereof along an advancement axis, and which is capable of pressing the two opposing plates 2 overlaying one another into an opening 3 of a die 4. The die consists of the fixed sections 5 of a forging die 6, as well as the segments 7 which can be moved axially outwards, and which are actuated by leaf springs 8 in the starting position, as shown. The leaf springs 8 are fixed to the forging die 6 by screws 9, and are located in a longitudinal groove of the forging die 6. The opening 3 is limited at its bottom by a base 12 which is created by the forging die 6.

Figure 2:
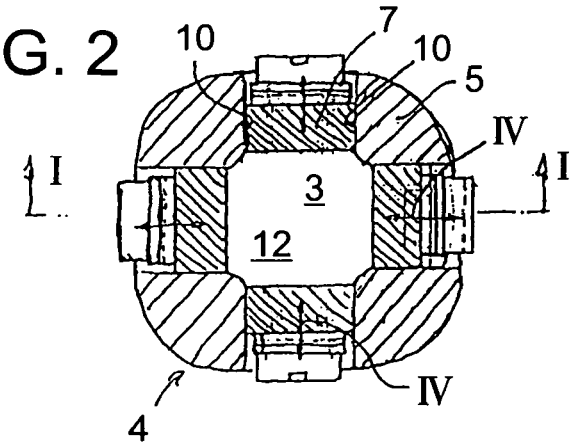
FIG. 2 is a partial cross-sectional view taken along II-II in FIG. 1.

As shown in FIG. 2, the segments 7 between the fixed sections 5 of the forging die 6 can be moved radially, guided by the guide walls 10 on the fixed sections 5 of the forging die. Movement causes segments 7 to slide over the base 12 of the blind opening 3.

This movement causes segments 7 to be moved according to the displacement stroke IV. The press joint connection is achieved, in that the plates 2 are laid on the die 6, and the corresponding parts of the surface are pressed deeply into the blind opening 3, down to the bottom of the opening 12 by the punch 1, and then squashed together, so that the material is pushed radially outwards to the fixed sections 5, as well as segments 7 which form the radial wall of the blind opening 3. While the displaced material is held back by the fixed sections 5 of the die 4, the material in-between is displaced against the movable segments which give, so that the material can flow after them. The base 12 of the forging die 6 is configured to extend radially outward of the advancement axis to at least a position corresponding to a maximum distance of radial displacement of the movable segments 7 caused by material flow acting against the radially inward biasing thereof. This, as described at the beginning herein, is how a differing structure of the connecting point is created.

Figure 3:
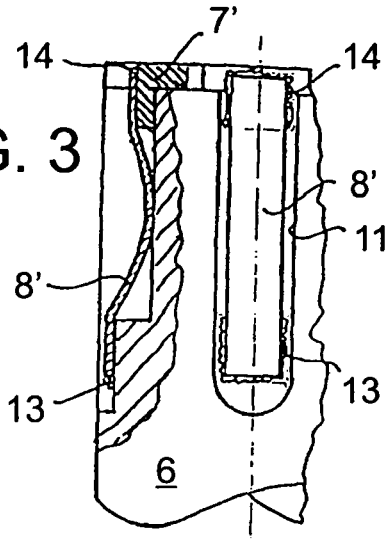
FIGS. 3-5 depict versions of the example embodiment of the invention.

FIG. 3 shows a version of an embodiment of the invention in which the leaf spring 8 is welded to the die at 13 and the segment. This creates a fixed connection, most importantly that of the segment 7 to the tool.

Figure 4:
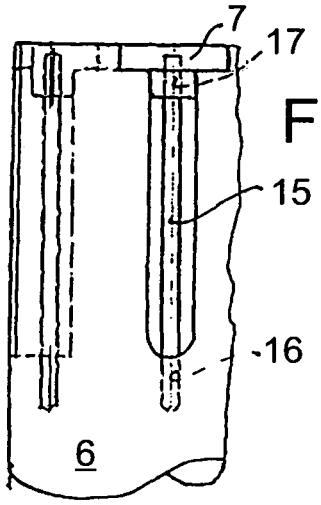

FIG. 4 shows a second version of this example, embodiment of the invention where a spring-pin 15 is used instead of a leaf spring 8 and is placed inside corresponding bore holes 16 of the die 6 or 17 of the segment 7.

Figure 5:
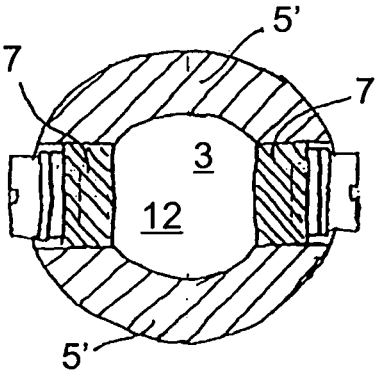

While the object shown in FIG. 2 has 4 segments 7 the version shown in FIG. 5 only has two such movable segments 7. The fixed sections 5 of this lower die are made wider accordingly and the structure of the connecting node is also correspondingly different.

All of the embodiments described in the following claims and the drawings can be used on their own or in any desired combination with each other in a novel fashion.

The invention claimed is:

1. A method of forming a pressed joint connection of components which include at least one plate, comprising:

interposing said components between an end of a punch and a die opening of a die leading into a die chamber;

advancing said punch along an advancement axis through the die opening of the die chamber to draw said components into said die opening, said chamber being bounded by circumferentially spaced elastically yielding movable wall segments which are movable in a radial direction of said advancement axis against radially inward biasing and fixed wall segments circumferentially disposed between said movable wall segments which are secured against movement in said radial direction, and by a base arranged crosswise to said advancement axis and opposite to said opening; and causing material of the components drawn into said opening to flow radially outward by axial compression thereof against said base of the die chamber created by continued advancing of the punch thereby radially displacing said elastically yielding wall segments against said inward biasing and being stopped by said fixed wall segments circumferentially therebetween, said base being configured to extend radially outward of said advancement axis to at least a position corresponding to a maximum distance of radial displacement of the movable wall segments caused by material flow acting against the radially inward biasing, such that the material being drawn by said advancing and said continued advancing is fully supported by the base over an entirely of said radial displacement of the joined material in a region located radially inward of each of the movable wall segments.

2. A method according to claim 1, wherein a distribution of radial resistance relative to a circumference of the die opening is centrally symmetrical.

3. A method according to claim 1, further comprising introducing adhesive between said components to supplement said press joint connection.

4. A method according to claim 1, wherein at least one plate includes at least two plates which are connected as overlaying one another.

5. A method according to claim 1, wherein said base is formed by a forging die located in a position adjacent to said die in a direction of said advancement axis.

6. A tool for forming a press joint connection of components which include at least one plate, comprising:

a punch advanceable along an advancement axis; and a die including a die chamber having an opening, an interior of said die clamber being bounded by circumferentially spaced elastically yielding movable wall segments which are movable in a radial direction of said advancement axis against a radially inward biasing and fixed wall segments circumferentially disposed between said movable wall segments which are secured against movement in said radial direction, and by a base arranged crosswise to said advancement axis and opposite to said opening;

said punch being advanceable into said opening of said die along said advancement axis, said components being positionable between said punch and said opening, such that material of the components is drawn into said opening by advancement of said punch into said opening and is caused to flow radially outward by axial compression thereof against said base of the die chamber by continued advancement of the punch, thereby radially displacing said elastically yielding wall segments against said inward biasing and being stopped by said fixed wall segments circumferentially therebetween, said base being configured to extend radially outward of said advancement axis to at least a position corresponding to a maximum distance of radial displacement of the movable wall segments caused by material flow acting against the radially inward biasing, such that the material being drawn by said advancement of the punch is fully supported by the base over an entirely of said radial displacement of the joined material in a region located radially inward of each of the movable wall segments.

7. A tool according claim 6, wherein a height of the elastically yielding wall segments is the same as a depth of the die chamber from the opening to the base.

8. A tool according claim 6, wherein a volume of the material at a starting point before a press joint connection process begins is greater than a corresponding volume difference between a die chamber volume of the die chamber without said radial displacement of said movable wall segments and minus a punch volume of a portion of the punch receivable in the die chamber.

9. A tool according to claim 6, further comprising a spring against which the movable wall segments are radially movable.

10. A tool according to claim 9, wherein the movable wall segments are at least partially received in wall openings which run in the radial sliding direction of the segments, said wall openings being laterally defined by guide walls on a same level as said base.

11. A tool according to claim 9, wherein said spring includes a leaf spring or spring-pin located on the die.

12. A tool according to claim 11, wherein:

the die includes at least one longitudinal groove; and said at least one spring is guided in said at least one longitudinal groove.

13. A tool according to claim 11, wherein:

said at least one spring includes springs;

the springs on a base end of the segments are connected together as one piece over a connecting section; and there is an offset of a same amount in a junction section between the connecting section and the springs in a direction of the movable wall segments.

14. A tool according to claim 13, wherein:

said base is formed by a forging die located in a position adjacent to said die in a direction of said advancement axis; and the connecting section is located in a jointing section of the forging die which runs transverse to the advancement axis.

15. A tool according to claim 13, wherein the connecting section is in a form of a cross or a star.

16. A tool according to claim 13, wherein grooves are provided in a longitudinal direction and/or in a bottom section of a forging die to receive springs and/or the connecting section.

17. A tool according to claim 6, wherein said circumferentially spaced elastically yielding movable wall segments include two movable wall segments disposed in circumferentially opposed positions.

18. A tool according to claim 6, wherein said circumferentially spaced elastically yielding movable wall segments include four movable wall segments disposed symmetrically arranged circumferential positions.

* * * * *